US007556263B2

(12) United States Patent
Kitagawa et al.

(10) Patent No.: US 7,556,263 B2
(45) Date of Patent: Jul. 7, 2009

(54) PAPER STACKING APPARATUS

(75) Inventors: Naofumi Kitagawa, Seto (JP); Shinji Shibata, Nagoya (JP); Minoru Kadowaki, Toyota (JP)

(73) Assignee: Hitachi-Omron Terminal Solutions, Corporation, Tokyo (JP)

( * ) Notice: Subject to any disclaimer, the term of this patent is extended or adjusted under 35 U.S.C. 154(b) by 221 days.

(21) Appl. No.: 11/439,439

(22) Filed: May 24, 2006

(65) Prior Publication Data

US 2007/0045396 A1 Mar. 1, 2007

(30) Foreign Application Priority Data

Aug. 31, 2005 (JP) ..... 2005-250519

(51) Int. Cl.
*B65H 31/04* (2006.01)
*B65H 31/10* (2006.01)

(52) U.S. Cl. ..... 271/213; 271/217; 271/215; 271/220; 271/207

(58) Field of Classification Search ..... 271/213, 271/217, 214, 215, 220, 223, 207, 199, 149, 271/150, 176, 271
See application file for complete search history.

(56) References Cited

U.S. PATENT DOCUMENTS 3,722,879 A * 3/1973 Johnston et al. ..... 271/176
4,229,650 A * 10/1980 Takahashi et al. ..... 250/223 R
4,577,853 A * 3/1986 Duke ..... 271/217
4,880,350 A * 11/1989 Stobb ..... 414/790.2
5,318,401 A * 6/1994 Mandel ..... 414/792.7
5,961,115 A * 10/1999 Blanck et al. ..... 271/263
6,145,826 A * 11/2000 Kawata ..... 270/58.28
6,390,466 B1 * 5/2002 Sanmiya ..... 271/213
6,773,004 B2 * 8/2004 Obregon et al. ..... 270/58.09
7,029,008 B2 * 4/2006 Nishida et al. ..... 271/223
2004/0070140 A1 * 4/2004 Michels ..... 271/215

FOREIGN PATENT DOCUMENTS

JP 11-71055 A 3/1999
JP 2000-187752 A 7/2000

* cited by examiner

*Primary Examiner*—Patrick H Mackey
*Assistant Examiner*—Luis Gonzalez
(74) *Attorney, Agent, or Firm*—McDermott Will & Emery LLP

(57) ABSTRACT

A bottom surface of a stacking and accommodating portion is structured such as to be sloped to be lower in accordance with moving away from a paper carry-in side, and a push plate is controlled so as to be moved in a direction moving close to a carry-in port of the paper by detecting a stack paper width determined on the basis of a product of a stacked number count information of the papers and a thickness information per one paper, and the papers are accommodated.

4 Claims, 7 Drawing Sheets

PAPER STACKING APPARATUS

INCORPORATION BY REFERENCE

The present application claims priority from Japanese application JP2005-250519 filed on Aug. 31, 2005, the content of which is hereby incorporated by reference into this application.

BACKGROUND OF THE INVENTION

1. Field of the Invention

The present invention relates to a paper stacking apparatus, and more particularly to a paper stacking apparatus which is suitable for stacking a lot of plural kinds of papers.

2. Description of Related Art

In accordance with a propagation of an automated teller machine (ATM) or the like, in a paper stacking apparatus stacking papers such as bank bills or the like, the needs of a smaller size, a lower cost, a less weight and the like are increased while securing conventional function and performance. Further, an apparatus which can process foreign bank bills in addition to domestic bank bills is required, levels of a fold and a break of the paper are deemed to be in a more adverse condition than the domestic one in view of distribution circumstances in the countries. Accordingly, an adverse effect is greatly applied to reservation of an accommodating number. Further, in most cases, the sizes of the papers are largely different in a direction of a long line and a direction of a short line. Accordingly, there is required that the paper stacking apparatus has a great capacity in the accommodating number of the paper while being in a compact size.

Conventionally, as this kind of paper stacking apparatus, there is a technique of controlling the stacked paper so as to move in a direction of moving away from a carry-in port by a pressing plate and a bottom surface belt in such a manner that the carried paper and the stacked paper are not interfered, in accordance with an increase of the stack paper to be stacked in the paper stacking apparatus (JP-A-2000-187752). Further, there is a technique of controlling a motion of the pressing plate and controlling so as to enlarge a stacking space on the basis of a leading end surface detection signal detecting a position of a leading end surface of the stacked paper, and preventing an excess gap from being generated between the stacked papers (JP-A-11-71055).

BRIEF SUMMARY OF THE INVENTION

In JP-A-2000-187752, since the bottom surface belt or the like is arranged, a structure within the apparatus is complicated, and it is necessary to secure a space for a structure necessary for the control. Therefore, there is a problem that it is impossible to reduce a number of the parts, and it is impossible to enlarge the stacking space for increasing an accommodating capacity. Further, in JP-A-11-71055, in the case that a lot of papers are continuously stacked, and the stacked papers become more bulky than the normal state due to an increase of the thickness caused by a wrinkle or a fold habit, a gap is generated between the stacked papers. Therefore, there is a problem that the accommodating number is reduced. Further, in the case of a vertical accommodating type, an aligning mechanism is independently required for aligning lower ends of the papers having different heights.

An object of the present invention is to provide a paper stacking apparatus which can increase an accommodating number of the papers sequentially carried and stacked on the basis of a simple structure, even in the case that a kind, a size and a state of the paper are different.

In order achieve the object mentioned above, in accordance with the present invention, there is provided a paper stacking apparatus comprising:

a paper inlet to which a paper is input;

a stacking and accommodating portion sequentially stacking the carried paper;

a movable pressing plate mechanism; and a pressing pres mechanism portion controlling a position of the pressing plate, wherein a bottom surface of the stacking and accommodating portion is sloped so as to become lower in accordance with moving away from the paper carry-in port side.

Other objects, features and advantages of the invention will become apparent from the following description of the embodiments of the invention taken in conjunction with the accompanying drawings.

DETAILED DESCRIPTION OF THE INVENTION

A description will be in detail given below of an embodiment in accordance with the present invention with reference to the accompanying drawings.

Figure 1:
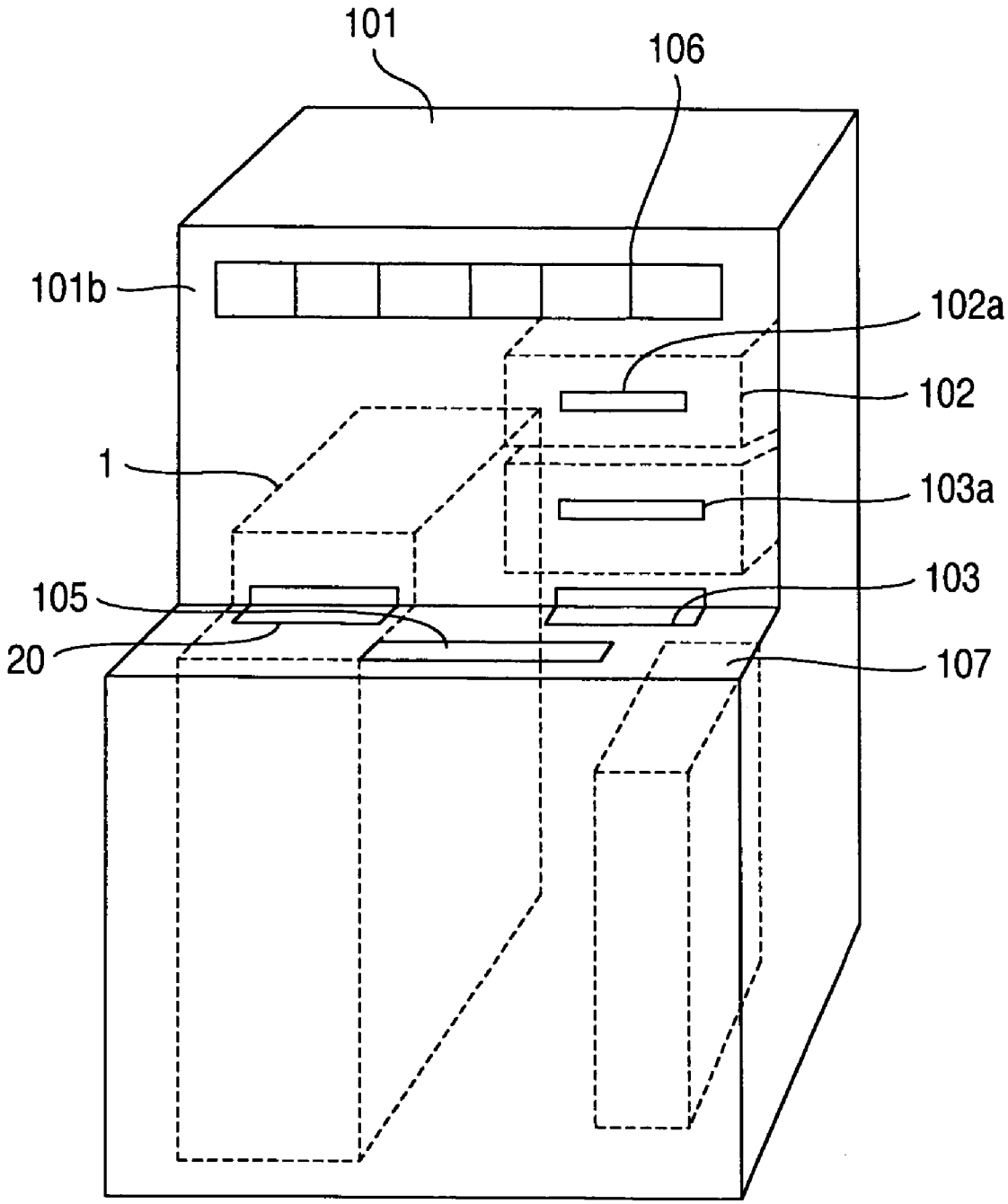
FIG. 1 is a perspective view showing an outer appearance of a cash automated transaction apparatus to which an embodiment in accordance with the present invention is applied.

First, FIG. 1 is a perspective view showing an outer appearance of a cash automated transaction apparatus in accordance with an embodiment of the present invention. An upper portion of a main body casing 101 of the cash automated transaction apparatus is provided with a card and detailed account processing mechanism 102 communicating with a card slot 102*a* provided in an upper portion front plate 101*b* of the casing 101, processing a card of a user and printing and discharging a transaction detailed account, and a passbook processing mechanism 103 communicating with a passbook slot 103*a* and processing a passbook of the user. Further, a lower portion of the main body casing 101 is provided with a bank bill input and output machine 1 processing a paper (for example, a bank bill) input or output through a money input and output port 20. Further, the cash automated transaction apparatus is provided with a customer operating portion 105 such as a touch panel or the like displaying and inputting contents of the transaction, a transaction display portion 106 such as a display or the like showing a kind of possible transaction such as a money input and a money output, and a main body control portion 107 executing a control of an entire of the cash automated transaction apparatus.

Figure 2:
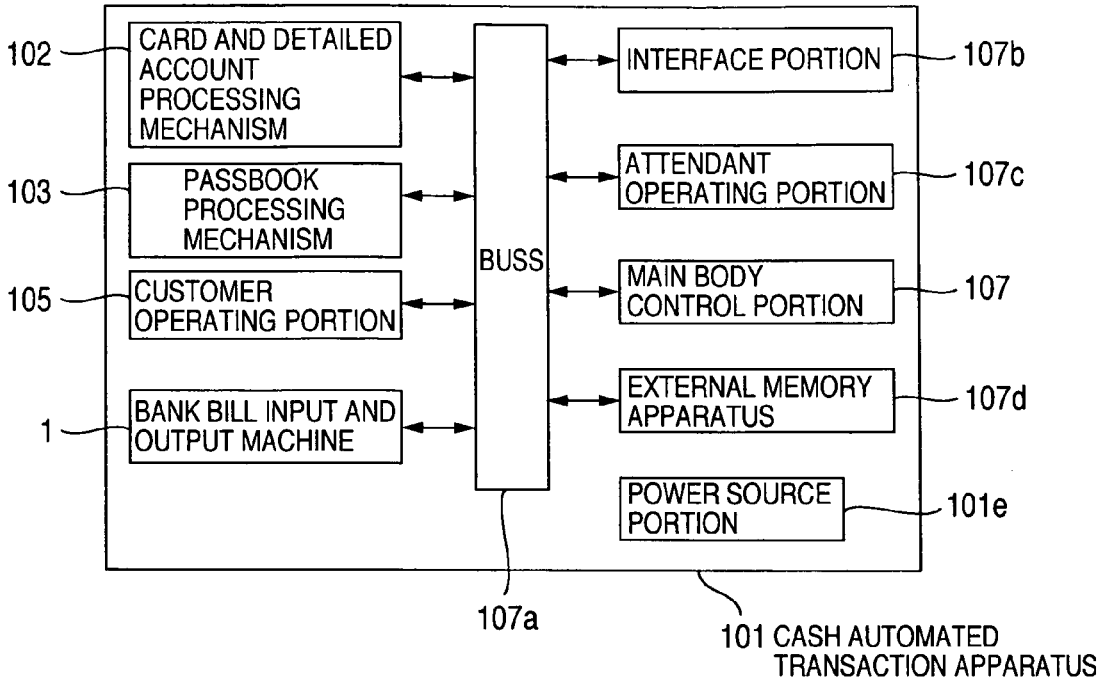
FIG. 2 is a block diagram showing a control relation of the cash automated transaction apparatus in FIG. 1.

FIG. 2 is a function block diagram showing an entire structure of a control system in accordance with the present apparatus. The control system is structured by using a computer, the card and detailed account processing mechanism 102 accommodated in the main body casing 101, the passbook processing mechanism 103, the bank bill input and output machine 1 and the customer operating portion 105 are connected to the main body control portion 107 via a bus 107*a*, and the control system executes a necessary operation under the control of the main body control portion 107. The main body control portion 107 is connected to an interface portion 107*b*, an attendant operating portion 107*c* and an external memory apparatus 107*d* via a bus 107*a*, and exchanges a necessary data. The attendant operating portion 107*c* is operated by an attendant, and inputs various information such as a kind and an installed position of an installed accommodating box, a money kind accommodated in each of the accommodating box and the like. A power source portion 101*e* supplies an electric power to each of the mechanisms and the constituting portions of the main body casing 101.

Figure 3:
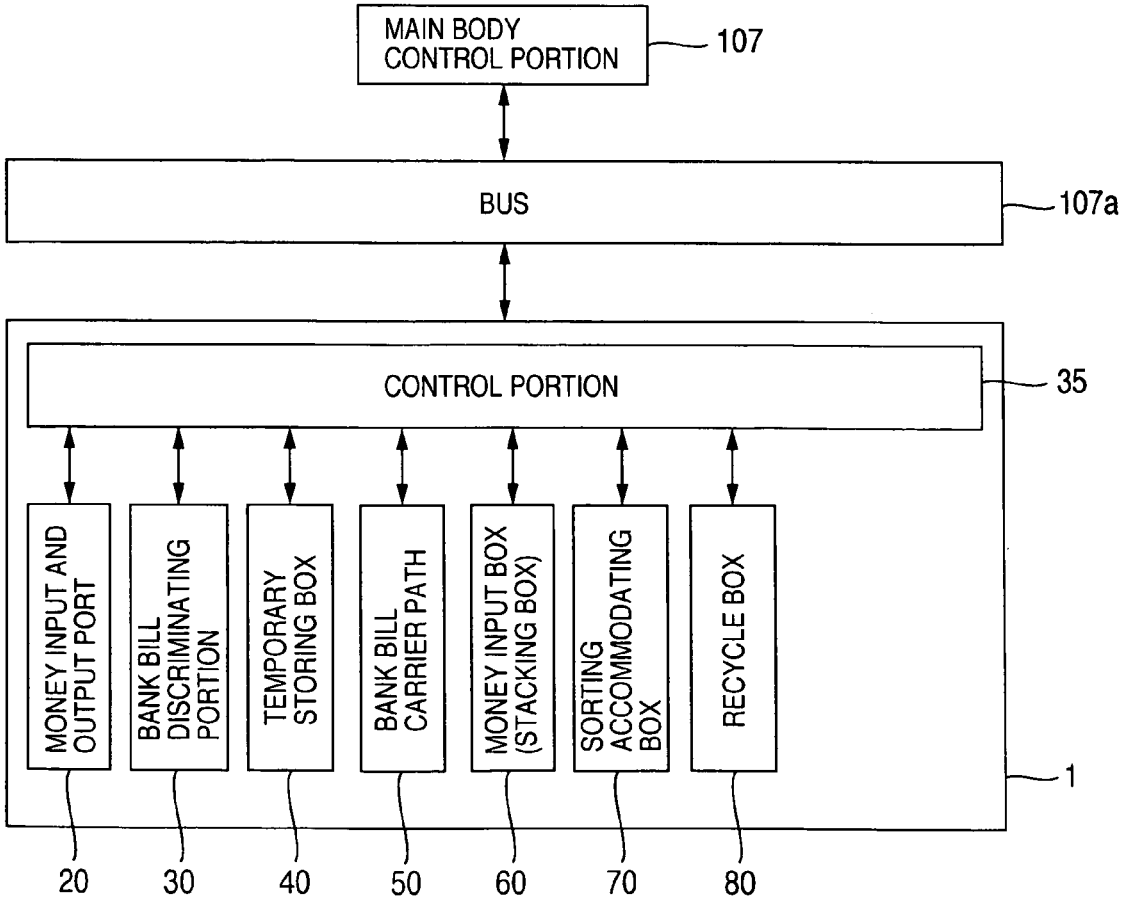
FIG. 3 is a block diagram showing a control relation of a bank bill input and output mechanism in accordance with an embodiment of the present invention.

FIG. 3 shows a detailed structure of an inner portion of the bank bill input and output machine 1. In FIG. 3, the bank bill input and output machine 1 is constituted by a money input and output port 20 by which the user inputs and outputs the bank bill, a bank bill discriminating portion 30 executing a discrimination of the bank bill, plural kinds of detachable accommodating boxes (described in detail below) accommodating the bank bill, a bank bill carrier path 50, and a control portion 35 such as a processor controlling these mechanism portions. As the accommodating box, there can be considered several kinds such as a temporary storing box 40 temporarily accommodating the input bank bill until the transaction is established, a money input box (a stacking box) 60 accommodating the bank bill which is not used for recycle, a sorting accommodating box 70 capable of accommodating many kinds of input bank bills in a sorted manner, a recycle box 80 used both as inputting money and outputting money and the like.

The control portion 35 is connected to the main body control portion 107 of the cash automated transaction apparatus via the bus 107*a*, and executes a control of the bank bill input and output machine 1 in correspondence to a command from the main body control portion 107 and a state detection of the bank bill input and output machine 1. Further, the control portion 35 transmits the state of the bank bill input and output machine 1 to the main body control portion 107 as occasion demands. Further, the control portion 35 is connected to a drive motor, an electromagnetic solenoid and a sensor of each of the units such as the money input and output port 20, the bank bill discriminating portion 30, the temporary storing box 40, the bank bill carrier path 50, the money input box (or the stacking box) 60, the sorting accommodating box 70, the recycle box 80 and the like in the bank bill input and output machine 1, and drives and controls each of actuators while monitoring the state by the sensor in correspondence to the transaction.

Figure 4:
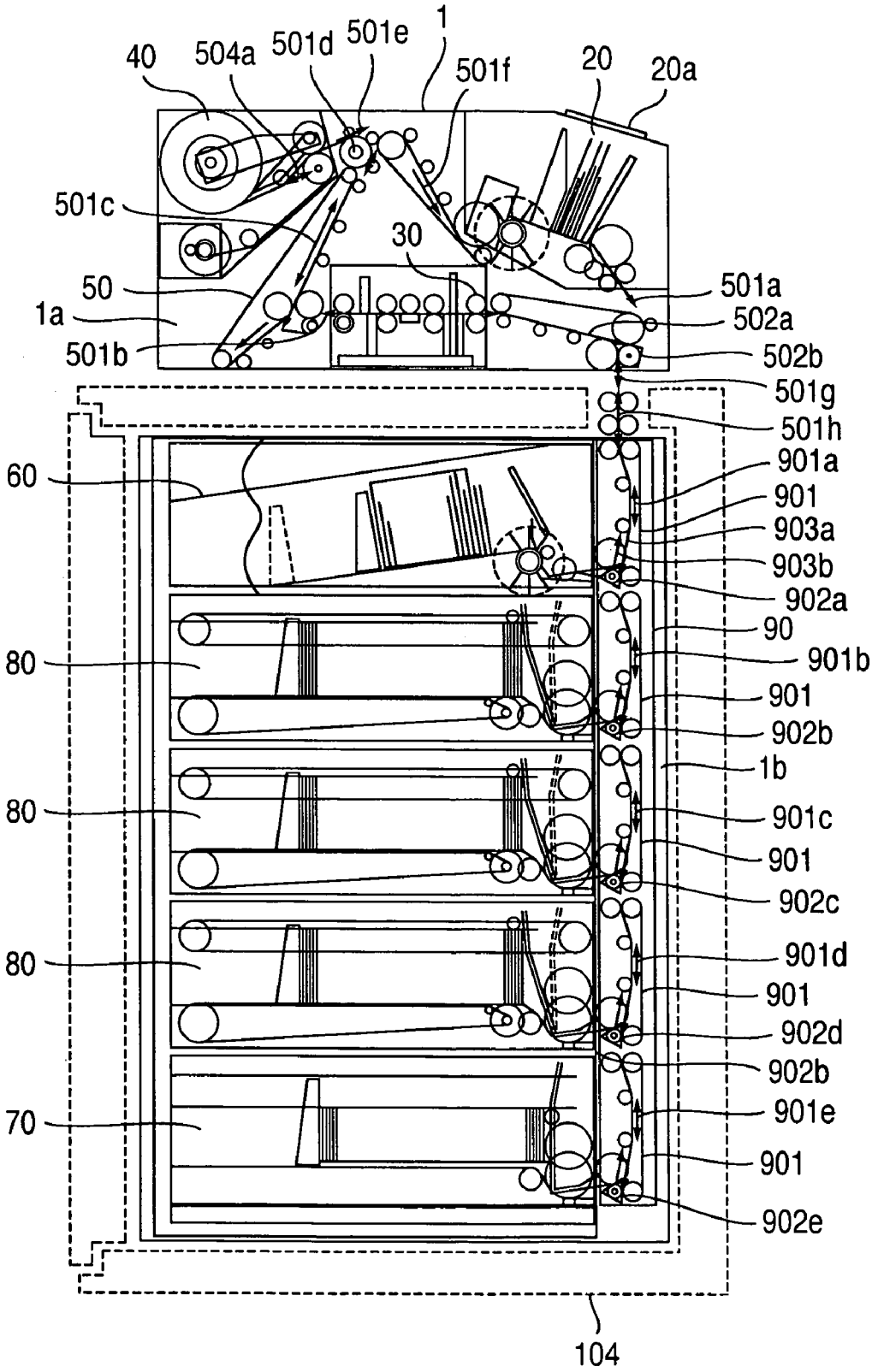
FIG. 4 is a side elevational view showing the bank bill input and output mechanism.

FIG. 4 is a side elevational view of the bank bill input and output machine 1 in the cash automated transaction apparatus in FIG. 1.

As shown in FIG. 4, the bank bill input and output machine 1 is constituted by an upper bank bill mechanism 1*a* and a lower bank bill mechanism 1*b*. The upper bank bill mechanism 1*a* is constituted by the money input and output port 20, the bank bill discriminating portion 30, the temporary storing box 40 and the bank bill carrier path 50. The bank bill carrier path 50 carries the bank bill between the money input and output port 20 and each of the accommodating boxes 60, 70 and 80 through the bank bill discriminating portion 30. Each of the accommodating boxes such as the money input box (the stacking box) 60, the sorting accommodating box 70 and the recycle box 80is structured such as to have a common casing outer shape, a bank bill inlet and outlet provided at a common position and a common drive portion, and be attached to an accommodation installed portion of the bank bill input and output machine 1 so as to be replaced by each other.

The lower bank bill mechanism 1*b* is constituted by the money input box (the stacking box) 60, the sorting accommodating box 70, the recycle box 80 and an openable carrier path 90 arranged in a front face of each of the accommodating boxes. Further, the lower bank bill mechanism 1*b* is mounted in a safe casing 104 constituted by a thick iron plate having a thickness of about 50 mm, and a carrier path 501*g* of the upper bank bill mechanism 1*a* and a carrier path 901*a* of the lower bank bill mechanism 1*b* are connected by a coupling carrier path 501*h*.

The coupling carrier path 501*h* is arranged within a slit provided in an upper iron plate portion of the safe casing 104 surrounding the lower bank bill mechanism 1*b* and at a position where the carrier path 501*g* of the upper bank bill mechanism 1*a* and the carrier path 901*a* of the lower bank bill mechanism 1*b* are coupled. The slit formed in the upper iron plate portion has a length for passing the bank bill therethrough and a width of a carrier roller attached in such a manner as to pinch the bank bill carried to the slit so as to deliver. When the upper bank bill mechanism 1*a* is directly mounted on the lower bank bill mechanism 1*b* in the case of employing the structure in which the lower bank bill mechanism 1*b* is not surrounded by the safe casing, the slit is not necessarily provided. The drive source of the carrier path 50, for example, a motor may be independently provided in the carrier path of the upper bank bill mechanism and the carrier path of the lower bank bill mechanism, or a driving force may be transmitted by a gear provided between the carrier paths 501*g*-501*h*-901*a* by using a single drive source.

Further, the bank bill carrier path 50 passes through the bank bill discriminating portion 30 in both directions, and connects the money input and output port 20, the temporary storing box 40, the money input box (the stacking box) 60, the recycle box 80 and the sorting accommodating box 70 via carrier paths shown by arrows 501*a*to 501*h*and 901*a*to 901*e*.

In the bank bill carrier path 50, five bank bill carrier paths 901*a* to 901*e* positioned in front portions of the money input box (the stacking box) 60, the recycle box 80 and the sorting accommodating box 70 in the lower bank bill mechanism 1*b* constitute an open and close carrier path 90 structured such as to be integrally opened and closed, and the attendant can execute the operation of the money input box (the stacking box) 60, the recycle box 80 and the sorting accommodating box 70 by opening the open and close carrier path 90.

A description will be given below of a structure example and an operation of the bank bill accommodating apparatus.

Figure 5:
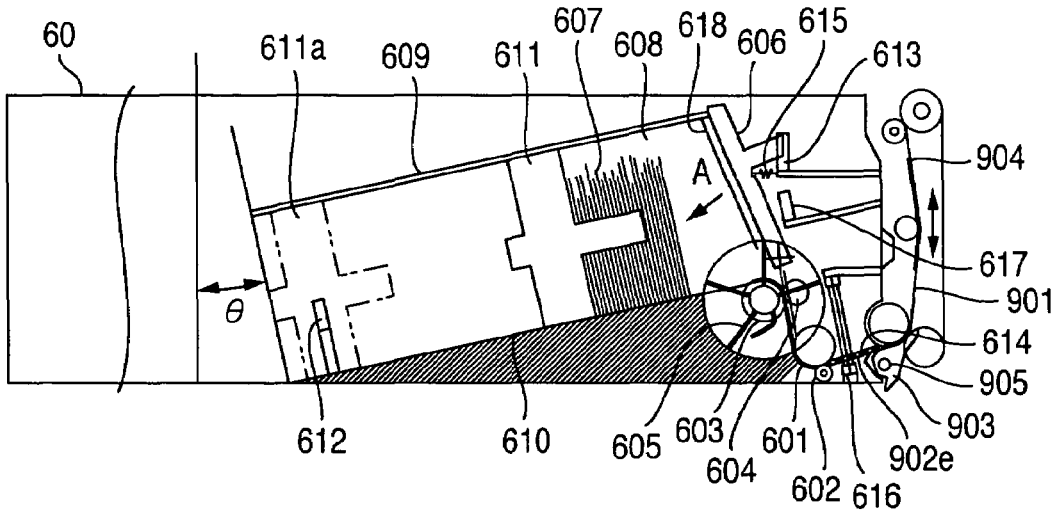
FIG. 5 is a side elevational view of a money input box (a stacking box) in FIG. 4.

FIG. 5 shows a detailed structure of the stacking box 60. A stack mechanism of the stacking box 60 is constituted by an entrance roller 601 driven by a drive source in an outer side of the stacking box via a gear so as to rotate, a pinch roller 602 facing to the entrance roller 601, a stack roller 603 driven from the entrance roller 601 via a gear so as to rotate, a stack pinch roller 604 facing to the stack roller 603, a sheet roller 605 rotating on the same axis as that of the stack roller 603 and having elastic members arranged in a radial pattern as illustrated, and a stack guide 606 guiding the carried bank bill so as to stack in a carrier space and rotatably supported so as to be brought into contact with a leading end surface of the stacked bank bill 607.

Further, a stacked bank bill stacking and accommodating space 608 is constituted by a ceiling 609, a lower carrier guide 610 and a push plate 611. The lower carrier guide 610 is structured such as to be lower in accordance with being away from the paper carry-in side. The push plate 611 corresponds to a push plate which can stack the fed bank bill in a left side in the drawing and can move right and left and is driven by a drive source (for the push plate) (not shown. The push plate 611 executes a movement control on the basis of the carry of the bank bill. In this case, the push plate 611*a* corresponds to the push plate 611 existing at a retracted position to the lower limit.

A fill detecting sensor 612 corresponds to a light sensor detecting a dark on the basis of a shield of the push plate 611 at a time when the stacking space is filled. A leading end detecting sensor 613 corresponds to a light sensor which is shielded on the basis of a rotation of the stack guide 606 and detects the dark. Further, a bank bill inlet 614 is provided in a front side of the entrance roller 601. An empty detecting sensor 617 corresponds to a light sensor detecting the dark on the basis of the shield of the push plate 611 at a time when the stacking space is empty.

A carrier belt 901 is driven by a drive source (not shown), is arranged in a relatively facing position, and pinches and carries the bank bill. A pinched bank bill 904 is carried in a downward direction in the drawing. A switch gate 903 rotates around a shaft 905 by a drive source (not shown).

Next, a description will be given of a motion of the bank bill in the bank bill stacking operation. The bank bill 904 pinched and carried by the carrier belt 901 is guided to the bank bill stacking apparatus 60 by the switch gate 903, is carried in a direction of an arrow 902*a*, and is fed in a portion between the rotating entrance roller 601 and the pinch roller 602. The bank bill fed in the portion between the entrance roller 601 and the pinch roller 603 is fed in a portion between the stack roller 603 and the stack pinch roller 604. Next, the bank bill goes along the stack guide 606 on the basis of a feeding force by the stack roller 603 and the stack pinch roller 604, is brought into contact with the ceiling 609, is scraped down at a rear end by the sheet roller 605, and is stacked one by one in front of the already stacked bank bill. The bank bill 618 moving forward into the bank bill stacking and accommodating space 608 is stacked by being moved in a direction A on the basis of an empty weight of the bank bill 618 and the force generated by the sheet roller 605 scraping down the rear end of the bank bill.

Since the lower carrier guide 610 is structured such as to become lower in accordance with moving away from the paper carry-in side, it is easy to suppress a forward collapse of the stacked bank bills and to align the lower ends of the bank bills having different heights. In other words, if an angle θ of slope of the lower carrier guide 610 with respect to a perpendicular line is small, the forward collapse tends to be generated, and if the angle of slope is large, a width of the bank bill stacking and accommodating space 608 to enter into the limit height of the stocking box is limited to be narrow. Accordingly, an accommodating efficiency becomes lowered. In the case of a horizontal accommodating system such as the conventional stacking box, the belt is provided below the accommodating box, and the bank bill is compressed by driving the roller. Further, in the case of the conventional vertical accommodating system, it is impossible to align the lower ends of the bank bills having the different heights. However, since it is possible to prevent the forward collapse by forming the stacking and accommodating portion diagonal, it is possible to omit the belt in the lower portion corresponding to an extra structure, and it is possible to simplify the structure. Therefore, it is possible to form the bank bill stacking and accommodating space 608 wide.

Next, a description will be given of a push plate position control operation during the bank bill accommodating operation of the bank bill input and output machine 1 by using FIGS. 6 to 10 and FIG. 11 corresponding to a flow chart of the push plate operation.

Figure 6:
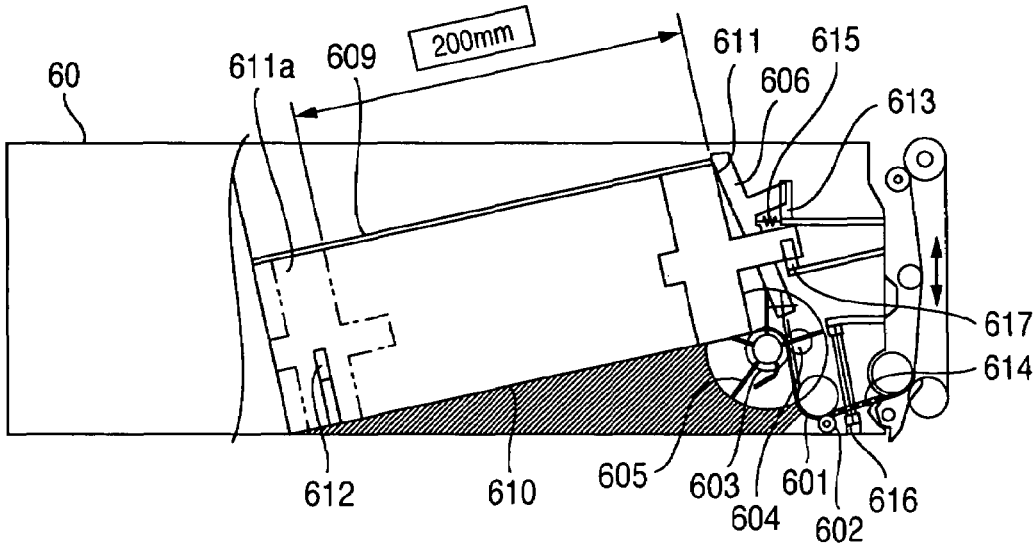
FIG. 6 is a side elevational view of the money input box (the stacking box) (with no bank bill)

As shown in FIG. 6, the space where the bank bill can be stacked is formed between a position at which the push plate 611 moves forward to a switch point of the leading end detection sensor 613, and a position at which the push plate 611 moves backward to the lower limit position, and the maximum width is 200 mm in the present embodiment.

Figure 7:
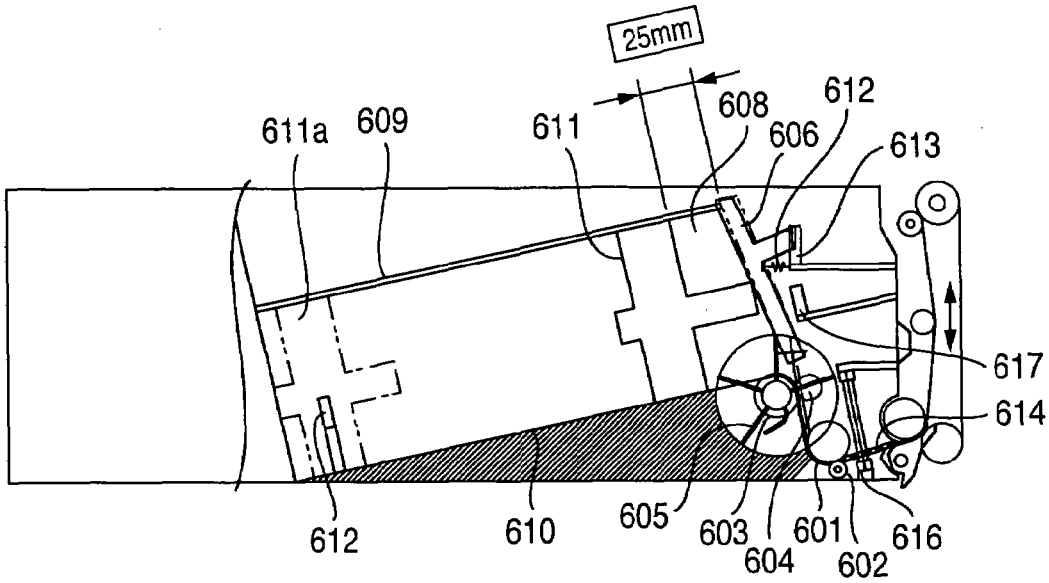
FIG. 7 is a side elevational view of the money input box (the stacking box) (a view of a state in which an accommodation is prepared)

Just before starting the bank bill accommodating operation, the push plate 611 moves backward to a position at which the leading end detecting sensor 613 detects the switch point from the dark to the light on the basis of the shield of the stack guide 606*m* as shown in FIG. 7, and moves backward further at 25 mm from the position, as an accommodation preparation. The present push plate backward moving control corresponds to a control executed in such a manner as to secure the forward moving port of the accommodated bank bill, prevent an interference (a jamming) from being generated between the bank bills, and prevent the bank bills from collapsing. Accordingly, the backward moving distance of the push plate 611 may be larger or smaller than 25 mm, as far as the bank bills are not interfered but can be accommodated without collapsing.

Further, the stack guide 606 is energized by a stack guide spring 615 in such a manner as to press the bank bill at the switch point of the leading end detecting sensor 613. The load is set in such a manner that even in the case that the bank bill is compressed by the push plate 611, the fed bank bill can enter into a portion between the stack guide 606 and the stacked bank bill 607 with no resistance, and the switching operation between the dark and the light of the leading end detecting sensor 613 can be securely executed. In the case that the load of the stack guide spring 615 is made large, the pressure between the stacked bank bill 607 compressed by the push plate 611 and the stack guide 606 becomes high. Accordingly, the fed bank bill yields to the pressure and can not enter into the accommodating space. Alternatively, since the fed bank bill is pinched between the stacked bank bill 607 and the stack guide 606, the sheet roller 605 can not scrape down the fed bank bill, and a resistance against the next fed bank bill is generated. Therefore, the next fed bank bill easily enters into the stacking box by setting the load of the stack guide spring 615 weaker than the load necessary for the moving operation of the push plate.

Figure 8:
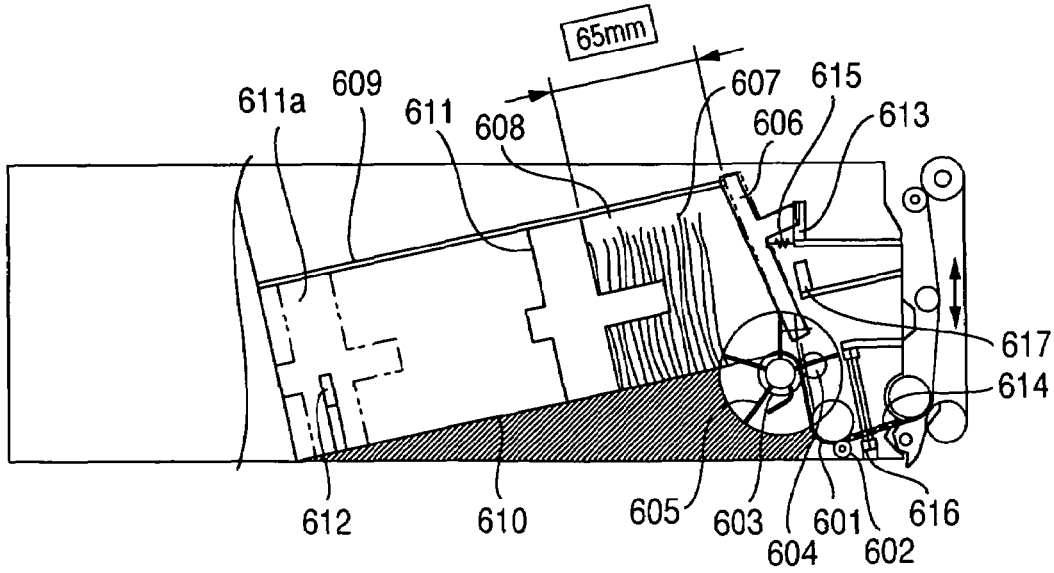
FIG. 8 is a side elevational view of the money input box (the stacking box) (a view of a state in which two hundreds of bank bills are accommodated)

Next, if the bank bill accommodating operation is started so as to start accommodating the bank bill sequentially, the push plate 611 moves backward at 0.2 mm per one accommodated bank bill as shown in FIG. 8. The present push plate backward moving control is not necessary in the case that it is set such that the push plate is largely moved backward at a time of preparing the accommodation, because it is possible to secure the backward moved bank bill stacking space on the basis of the compressing effect by the empty weight of the bank bill.

Figure 9:
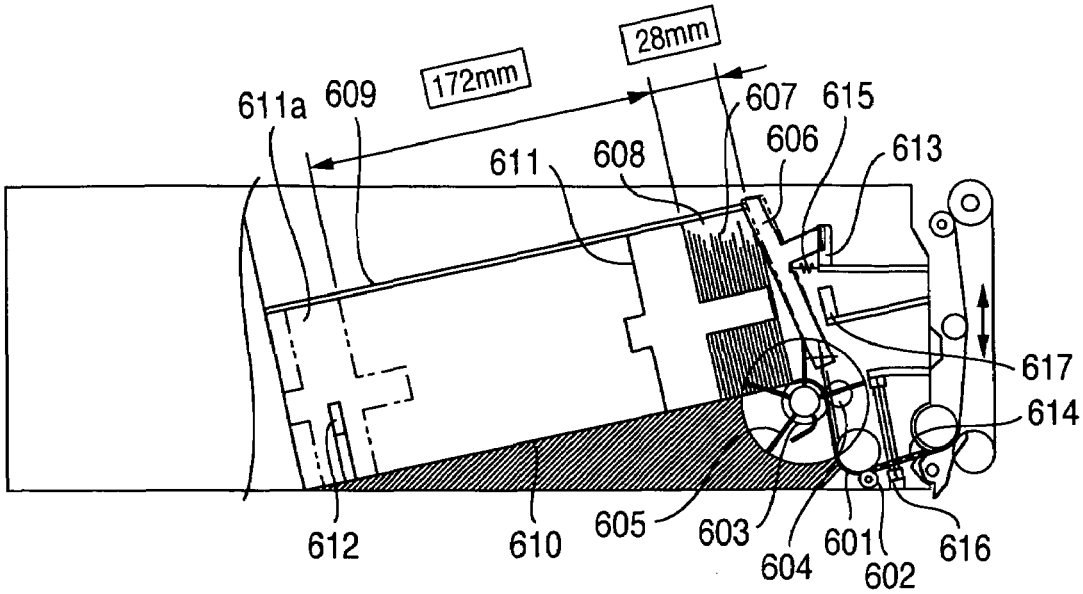
FIG. 9 is a side elevational view of the money input box (the stacking box) (a view of a state in which the accommodation is finished)

Finally, the push plate 611 moves forward to a position shown by FIG. 9 at a time when the bank bill accommodating operation is finished. The forward moving distance of the push plate is determined on the basis of a count information stored in the memory apparatus, and a thickness information per one bank bill stored in the memory apparatus. For example, in the case that the thickness information per one bank bill is 0.14 mm, and the count information is 200 sheets, the push plate 611 moves forward to a position obtained by subtracting a product of the number of the stacked bank bills 200 and the thickness per one bank bill 0.14 mm from the bank bill stacking space width 200 mm, that is, a position at a distance 172 mm from the push plate lower limit position shown in FIG. 9. In this case, the memory apparatus may be constituted by the external memory apparatus 107*d* of the cash automated transaction apparatus 101, or may be provided in the bank bill input and output machine 1 although not being illustrated in FIG. 3. Further, the number of the bank bills may be counted, for example, by the bank bill discriminating portion 30, and a result of counting may be stored in the memory apparatus.

In this case, the bank bill includes a new bill having no fold line and no wrinkle, a distributed bill having a small fold line and wrinkle due to the distribution, a fold habit bill having a strong fold line and curl habit, a wizened wrinkle bill and the like. In the case of laminating and accommodating the bank bills mentioned above, the stack height becomes minimum about 0.1 mm/sheet in the case that the new bills are laminated. The stack height becomes about 0.11 to 0.15 mm/sheet in the distributed bills, about 0.2 to 0.5 mm/sheet in the wrinkle bills, and maximum about 20 mm/sheet in the fold habit bills. However, the laminated bank bills come close to the original thickness of the bank bills by being crushed. In order to stably secure the increase of the accommodating number with respect to the bank bills, it is necessary to push back the bank bills to the real stacking space required for stacking at the original thickness of the bank bills at the stacked paper width obtained by detecting the stacked bank bills, that is, at the original thickness of the bank bills having a reduced wrinkles and fold habit, by controlling so as to move the push plate in a direction moving close to the carry-in port, on the basis of the stacked bank bill width determined by the product of the count information and the thickness information per one bank bill.

In this case, the thickness information per one bank bill can be variably set in correspondence to the thickness of the processed bank bill, and the thickness information of the processed bank bill may be previously set and stored before being made use. Further, it is possible to achieve a control better corresponding to the actual bank bill thickness by using the thickness information per one bank bill obtained by forming a bank bill thickness detecting portion in the bank bill discriminating portion 30 or the like and measuring the thickness.

Figure 10:
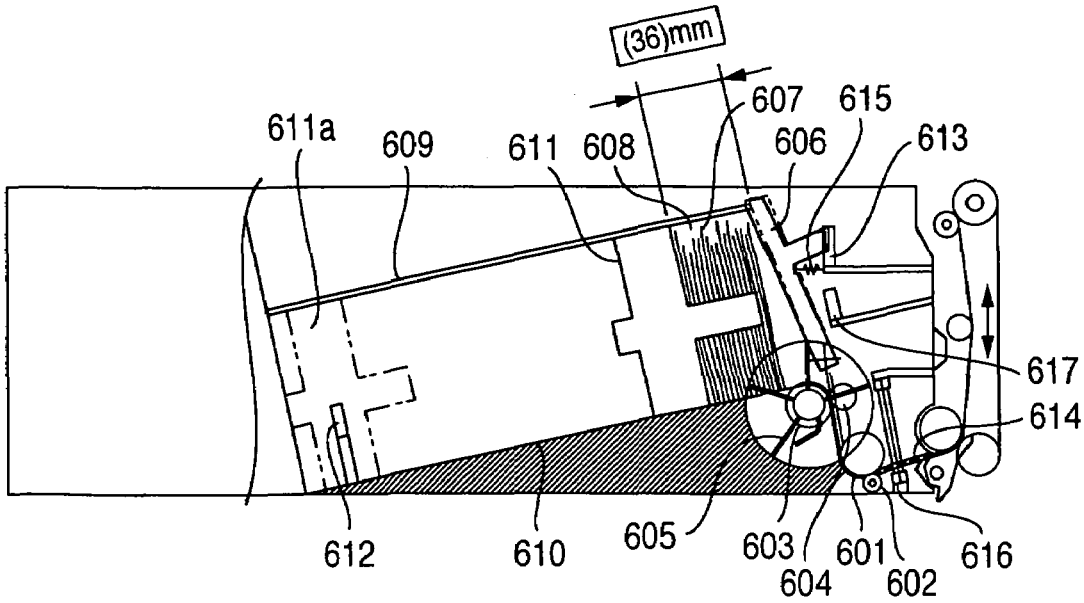
FIG. 10 is a side elevational view of the money input box (the stacking box) (a view of a position at which the bank bill is accommodated and prepared after being compressed)

Further, in the case of accommodating the bank bill carried in by the next transaction, the push plate 611 moves backward to the position where the leading end detecting sensor 613 detects the switch point from the dark to the light on the basis of the shield of the stack guide 606, in such a manner that the fed bank bill can enter into the portion between the stack guide 606 and the stacked bank bill 607 with no resistance, as the accommodation preparation. FIG. 10 shows a state in which the push plate 611 moves backward. In FIG. 10, in the case that the crushed stacked bank bills are constituted by the bank bills having a lot of wrinkles and fold habits, the thickness of the stacked papers becomes larger than the original thickness of the bank bills at a time when the state becomes FIG. 10 from FIG. 9. However, since it is possible to reduce the gap generated between the stacked bank bills, and the thickness increase caused by the wrinkle and the fold habit of the stacked bank bills, by once crushing as shown in FIG. 9, it is possible to narrow the width of the stacked bank bills in comparison with the case that the crushing is not executed. In other words, since it is possible to make the stacking space close to the real stacking space necessary for stacking at the original thickness of the bank bills having the reduced number of wrinkles and fold habits, it is possible to increase the accommodating number.

Figure 11:
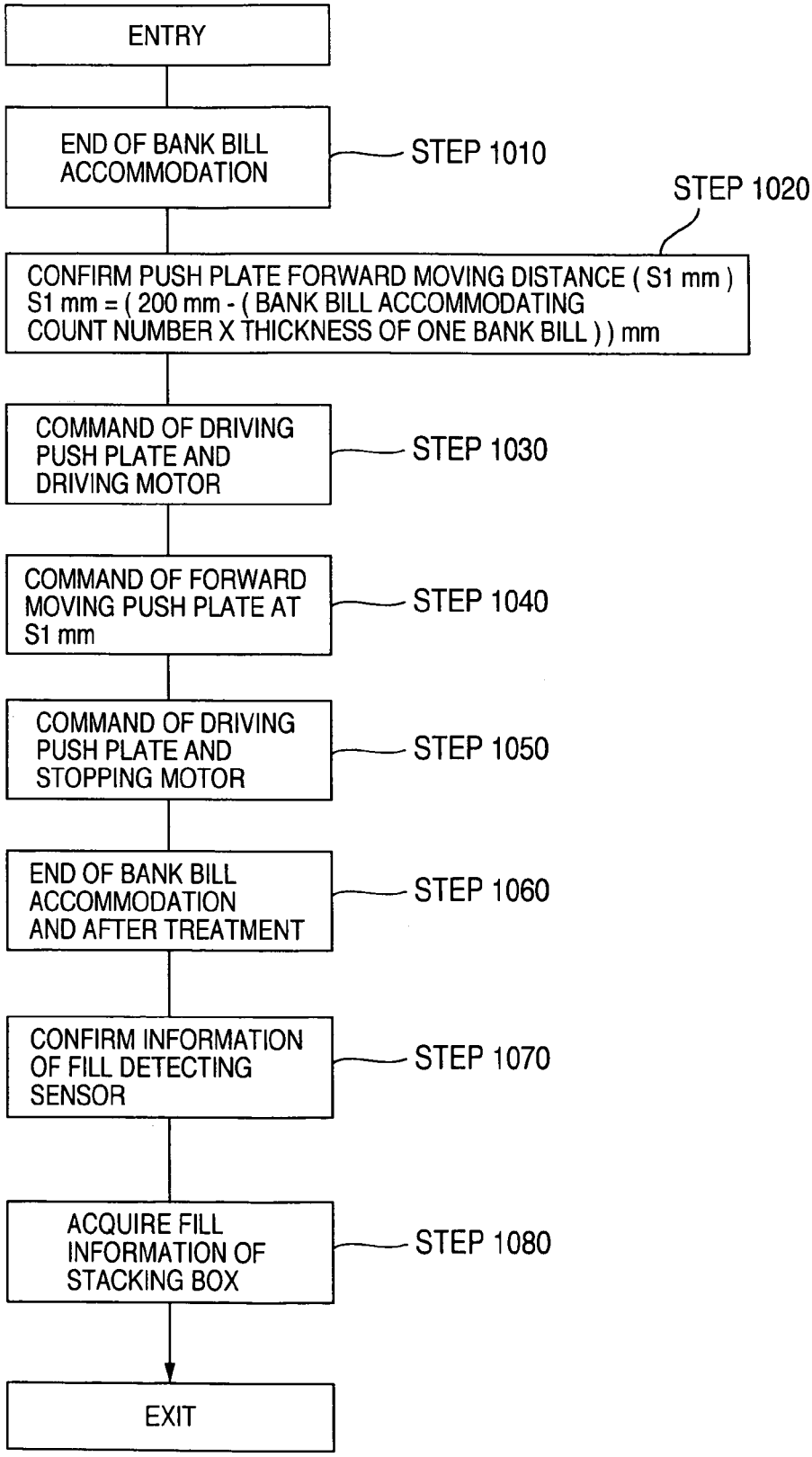
FIG. 11 is a flow chart of a plate pressing motion of the money input box (the stacking box).

FIG. 11 is a flow chart showing a bank bill accommodating operation of the stacking box in FIGS. 8 to 10. If the bank bill is accommodated in the stacking box as shown in FIG. 8, and the bank bill accommodation is finished (a step 1010), the control portion 35 calculates a distance at which the push plate 611 should move, on the basis of the number of the accommodated bank bills (a step 1020). Details thereof have been shown in the description in FIG. 9 mentioned above. Further, the control portion 35 applies a drive command to a push plate driving motor (a step 1030). Then, the push plate 611 moves at a distance calculated by the step 1020 (in other words, moves forward to the stack guide 606 side) (a step 1040). If the push plate 611 moves at the distance calculated by the step 1020, the control portion 35 applies a drive stop command to the push plate driving motor (a step 1050). A state shown in FIG. 9 is achieved by each of the steps mentioned above.

Further, in the state in FIG. 9, in the case that the bank bill is accommodated further in accordance with the next transaction, the push plate 611 moves at a predetermined distance (that is, moves backward to a side away from the stack guide 606) as shown in FIG. 10 (a step 1060). In this case, if the fill detecting sensor 612 becomes dark on the basis of the movement (the backward movement) of the push plate 611, the fill detecting sensor 612 detects that the bank bills are filled within the stacking box (a step 1070), can the control portion 35 acquires an information that the bank bills are filled (a step 1080). Further, the information is transmitted to the main body control portion 107, and the attendant operating portion 107*c* applies a display prompting a recovery and an exchange of the stacking box to the attendant by displaying the matter or the like.

In accordance with the present embodiment, since the bottom surface (the push plate 611) of the stacking and accommodating portion is structured such as to be sloped so as to be lower in accordance with moving away from the bank bill carry-in side, the bank bill moves in a direction of moving away from the carry-in port on the basis of the empty weight of the bank bill, and moves in the direction of the bottom surface of the stacking and accommodating portion. Accordingly, it is possible to increase the accommodating number on the basis of the pressing of the bank bill itself, and it is unnecessary to control such that the fed bank bill and the stacked bank bill are interfered. Further, even if the bank bills having the different sized in the height direction are carried in, the lower ends of the bank bills can be aligned. Accordingly, it is possible to simplify the structure within the apparatus on the basis of the reduction of the number of the constituting parts, it is easy to secure the space for increasing the accommodating space more, and it is possible to provide the paper stacking apparatus having a small size, a low cost and a reduced weight.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper stacking apparatus stacking fed papers, comprising:

a paper inlet to which said fed paper enters;

a stacking and accommodating portion stacking the papers entering from said inlet;

a movable push plate installed within said stacking and accommodating portion; and a control portion controlling a position of said push plate, wherein said stacking and accommodating portion is sloped in such a manner as to be lower in accordance with being away from said paper inlet, wherein said stacking and accommodating portion is provided with a leading end detecting means for detecting a position of a leading end surface of the papers stacked in said stacking and accommodating portion by detecting position of said stack guide, wherein the paper stacking apparatus further comprises a memory means for storing a stack number count information corresponding to the number of the papers accommodated and stacked in said stacking and accommodating portion, and a thickness information per one of said papers, wherein said control portion detects a stack width of the stacked papers on the basis of the count information and the thickness information per one paper stored in said memory means, wherein said control portion calculates a stack width of the papers stacking in said stacking and accommodating portion, on the basis of a product of the count information and the thickness information per one paper stored in said memory means, and wherein said control portion calculates a moving distance of said push plate and executes a control of moving said push plate by subtracting said stack width from the accommodation width of said stacking and accommodating portion.

2. A paper stacking apparatus as claimed in claim 1, wherein in the case that the other papers are further carried in under a state in which the papers are stacked in said stacking and accommodating portion, said control portion executes a control of moving said push plate in a direction moving away from said paper inlet.

3. A paper stacking apparatus as claimed in claim 2, further comprising a fill detecting sensor detecting that said stacking and accommodating box is filled with the papers in the case that said push plate moves in the direction moving away from said paper inlet.

4. A paper stacking apparatus stacking fed papers, comprising:

a paper inlet to which said fed paper enters;

a stacking and accommodating portion stacking the papers entering from said inlet;

a movable push plate installed within said stacking and accommodating portion;

a stack guide installed in said stacking and accommodating portion, capable of guiding the papers fed from said paper inlet in such a manner as to stack in said stacking and accommodating portion, capable of being rotatably supported to said stacking and accommodating portion in such a manner as to come into contact with a leading end surface of the stacked papers, and capable of being energized in such a manner as to press the papers in a direction of said push plate, said papers within the stacking and accommodating portion being stacked between said stack guide and said push plate; and a control portion controlling a position of said push plate, wherein said stacking and accommodating portion is sloped in such a manner as to be lower in accordance with being away from said paper inlet, wherein said stacking and accommodating portion is provided with a leading end detecting means for detecting a position of a leading end surface of the papers stacked in said stacking and accommodating portion, wherein the paper stacking apparatus further comprises a memory means for storing a stack number count information corresponding to number of papers accommodated and stacked in said stacking and accommodating portion, and a thickness information per one of said papers, wherein said control portion detects a stack width of the stacked papers on the basis of the count information and the thickness information per one paper stored in said memory means, wherein said control portion calculates a stack width of the papers stacking in said stacking and accommodating portion, on the basis of a product of the count information and the thickness information per one paper stored in said memory means, and wherein said control portion calculates a moving distance of said push plate and executes a control of moving said push plate by subtracting said stack width from the accommodation width of said stacking and accommodating portion.

* * * * *